US006359396B1

(12) United States Patent
Wicklund et al.

(10) Patent No.: US 6,359,396 B1
(45) Date of Patent: Mar. 19, 2002

(54) MULTIPLE-PARAMETER CONTROL OF LAMP IGNITION

(75) Inventors: Kurt W. Wicklund, Kenosha, WI (US); Patrick E. Troy, Chicago, IL (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/561,297

(22) Filed: Apr. 28, 2000

(51) Int. Cl.[7] ..... H05B 37/00
(52) U.S. Cl. ..... 315/360; 315/224; 315/362
(58) Field of Search ..... 315/307, 308, 315/291, 224, 360, 362, 225, 209 R, 219

(56) References Cited

U.S. PATENT DOCUMENTS

| | | | | | |
|---|---|---|---|---|---|
| 4,197,485 | A | | 4/1980 | Nuver | 315/291 |
| 4,745,341 | A | | 5/1988 | Herres | 315/176 |
| 4,896,077 | A | | 1/1990 | Dodd et al. | 315/289 |
| 4,996,464 | A | | 2/1991 | Dodd et al. | 315/289 |
| 5,142,203 | A | * | 8/1992 | Oda et al. | 315/308 |
| 5,151,631 | A | * | 9/1992 | Oda et al. | 315/308 |
| 5,384,516 | A | * | 1/1995 | Kawabata et al. | 315/307 |
| 5,424,617 | A | | 6/1995 | Garbowicz et al. | 315/289 |
| 5,801,494 | A | | 9/1998 | Herres et al. | 315/289 |
| 5,942,859 | A | * | 8/1999 | Okude et al. | 315/307 |

* cited by examiner

*Primary Examiner*—Don Wong
*Assistant Examiner*—Wilson Lee

(57) ABSTRACT

Starting of a gaseous discharge lamp is control led in response to both lamp voltage and duration of time during which igniting pulses are applied. An upper and a lower threshold voltage are utilized to determine whether the lamp is in an unstable starting mode, a cold starting mode, or a steady-state operating mode.

9 Claims, 8 Drawing Sheets

| Lamp Type (ANSI Designation) | Rated Power (Watts) | Operating Voltage Range (volts) | Minimum OCV $V_{OC}$ (volts) | High Threshold $V_{HI}$ (volts) | Low Threshold $V_{LO}$ (volts) |
|---|---|---|---|---|---|
| M130 | 39 | 80 - 100 | 198 | 150 | 40 |
| M85 | 70 | 83-105 | 198 | 150 | 40 |
| M81 | 150 | 85-105 | 198 | 150 | 40 |
| M136 | 200 | 117-147 | 209 | 175 | 60 |
| M102 | 150 | 85-105 | 216 | 150 | 40 |
| M80 | 250 | 85-110 | 230 | 150 | 40 |
| M110 | 50 | 75-95 | 235 | 150 | 40 |
| M98 | 70 | 75-100 | 235 | 150 | 40 |
| M90 | 100 | 90-110 | 235 | 150 | 40 |
| M91 | 100 | 90-110 | 235 | 150 | 40 |
| M57 | 175 | 117-147 | 245 | 200 | 60 |
| M138 | 250 | 118-148 | 245 | 200 | 60 |
| M132 | 320 | 120-150 | 245 | 200 | 60 |
| M135 | 400 | 120-150 | 245 | 200 | 60 |
| M131 | 350 | 120-150 | 249 | 200 | 60 |

FIG. 5

MULTIPLE-PARAMETER CONTROL OF LAMP IGNITION

BACKGROUND OF THE INVENTION

1. Field of the Invention

This invention relates to gaseous discharge lamps which ignite at voltages that are much higher than their operating voltages and, in particular, to the igniting of such lamps.

2. Description of Related Art

Common characteristics of a gaseous discharge lamp are its negative resistance and high igniting voltage. A circuit arrangement for powering such a lamp typically includes a current limiting means, such as a ballast, to compensate for the negative resistance, and often includes circuitry for generating high-voltage pulses to ignite the lamps. Such pulse-generator circuitry typically includes a voltage-sensitive switch (e.g. a sidac) for effecting the continual production of the high-voltage pulses until the lamp ignites. Upon ignition, the voltage across the lamp decreases from a higher open-circuit voltage (OCV) to a lower voltage, which causes the switch to change to a non-conducting state and to effect termination of pulse production. Such a circuit arrangement may also include timer circuitry for limiting the time period during which the high-voltage ignition pulses are applied to the lamp. Such timer circuitry typically includes another switch (e.g. a triac) for controlling the production of the high-voltage pulses independently of the pulse generator circuitry.

FIG. 1 illustrates a generalized example of known circuit arrangements of this type. Such circuit arrangements typically include a ballast B, an ignitor 12 and a gaseous discharge lamp L. The ballast includes input terminals T1 and T2 for connection to a power source (e.g. to a 120 VAC line). It further includes output terminals T3 and T4, for supplying power to the lamp L, and a terminal T5. The ignitor 12 includes a pulse generator 120 and a timer 124. The pulse generator is electrically connected to a conductor C, which carries current to the lamp, for applying high-voltage pulses to the lamp to effect ignition. An input of the timer 124 is electrically connected to the terminal T5 for detecting application of power to the lamp L. An output of the timer is electrically connected to the pulse generator 120 for controlling its activation.

Note that FIG. 1 is a functional block diagram. That is, each block represents a function, but does not necessarily indicate where the elements used to perform that function are located. They may be separately grouped in accordance with function to facilitate the use of plug-in modules. Alternatively, the circuit elements may be distributed to achieve certain other advantages, such as space conservation or temperature distribution. For example, the pulse generator 120 may include a low-impedance pulse-producing winding that is electrically connected in series with the conductor C. This winding may be a separate device or may physically form part of a transformer which is included in the ballast B.

Note further that a circuit arrangement of the type shown in FIG. 1 also includes or utilizes a power supply (not shown), such as a full-bridge rectifier, for converting AC voltage from the power source to DC voltage for powering the circuitry in the ignitor 12. For a specific example of a circuit arrangement of the above-described type, see U.S. Pat. No. 5,424,617.

In operation, the pulse generator 120 applies high-voltage igniting pulses to the lamp L for a predetermined period of time after power is applied via the ballast B. This time period is measured by the timer 124 and is generally equal to the maximum expected time needed to ignite the type of lamp with which the ignitor 12 is to be used. At the end of the predetermined time period, the timer disables the pulse generator. Such disablement is intended to prevent continual production of high-voltage If ignition pulses when a lamp is non-functional or when no lamp is present in the circuit.

While such timer circuit arrangements perform the important function of protecting against excessive high-voltage pulse generation, they typically have one or more of the following shortcomings:

Such circuit arrangements continually reignite (or attempt to reignite) lamps which are near their end of life. This undesirable trait, commonly called "cycling", both stresses the circuitry and lessens the likelihood of timely detecting and replacing end-of-life lamps. This is a common problem with certain types of gaseous-discharge lamps, such as high-pressure sodium (HPS) lamps, which have operating voltages that increase substantially with age.

The circuit arrangement may inactivate the pulse generator before the lamp has warmed up adequately to remain ignited. If power to an operating lamp is momentarily interrupted, the interruption may be long enough to extinguish the lamp but too short to enable reset of the timer. In this situation, the timer will not run at all or will provide less than the predetermined time needed to re-ignite the lamp.

SUMMARY OF THE INVENTION

It is an object of the invention to provide a method and an apparatus for igniting a gaseous discharge lamp in a manner which obviates the above-described shortcomings.

In accordance with the invention, the application of igniting pulses to the lamp is controlled in response to both time and upper and lower threshold voltages. The application of igniting pulses is enabled if:

igniting pulses have not been continuously applied to the lamp for an elapsed time exceeding a predetermined time period; and the lamp voltage is either above the upper threshold voltage or below the lower threshold voltage.

Lamp voltages above the upper threshold voltage indicate that the lamp has not ignited. Lamp voltages below the lower threshold voltage are too low to ensure that the lamp has become fully ignited. Lamp voltages below the lower threshold typically occur when a starting lamp has not fully warmed up.

Igniting of a gaseous discharge lamp in accordance with the invention provides a means for preventing the continued application of igniting power to non-functional or missing lamps and also for inhibiting "cycling" of end-of-life lamps. In either case, the detected lamp voltage will remain above the upper threshold voltage while igniting pulses are applied for longer than the predetermined time period. This is achieved by adjusting the upper threshold voltage and the predetermined time period to values that correspond to an age which is deemed to be a lamp's useful end-of-life. Further, by enabling the application of igniting pulses even while the lamp voltage is below the lower threshold voltage, the continued generation of such pulses will be permitted if a lamp that has not warmed up falls out of ignition.

In accordance with another feature of the invention, a timer for measuring the elapsed time is reset whenever the lamp voltage decreases from a voltage above the upper threshold voltage to a voltage below the upper threshold voltage. This ensures that the timer will allow the full predetermined time period to elapse if power is subsequently interrupted, regardless of the brevity of the interruption.

BRIEF DESCRIPTION OF THE DRAWING

FIG. 5 is a table illustrating exemplary electrical characteristics of some typical gaseous discharge lamps.

DESCRIPTION OF SOME PREFERRED EMBODIMENTS

Figure 1:
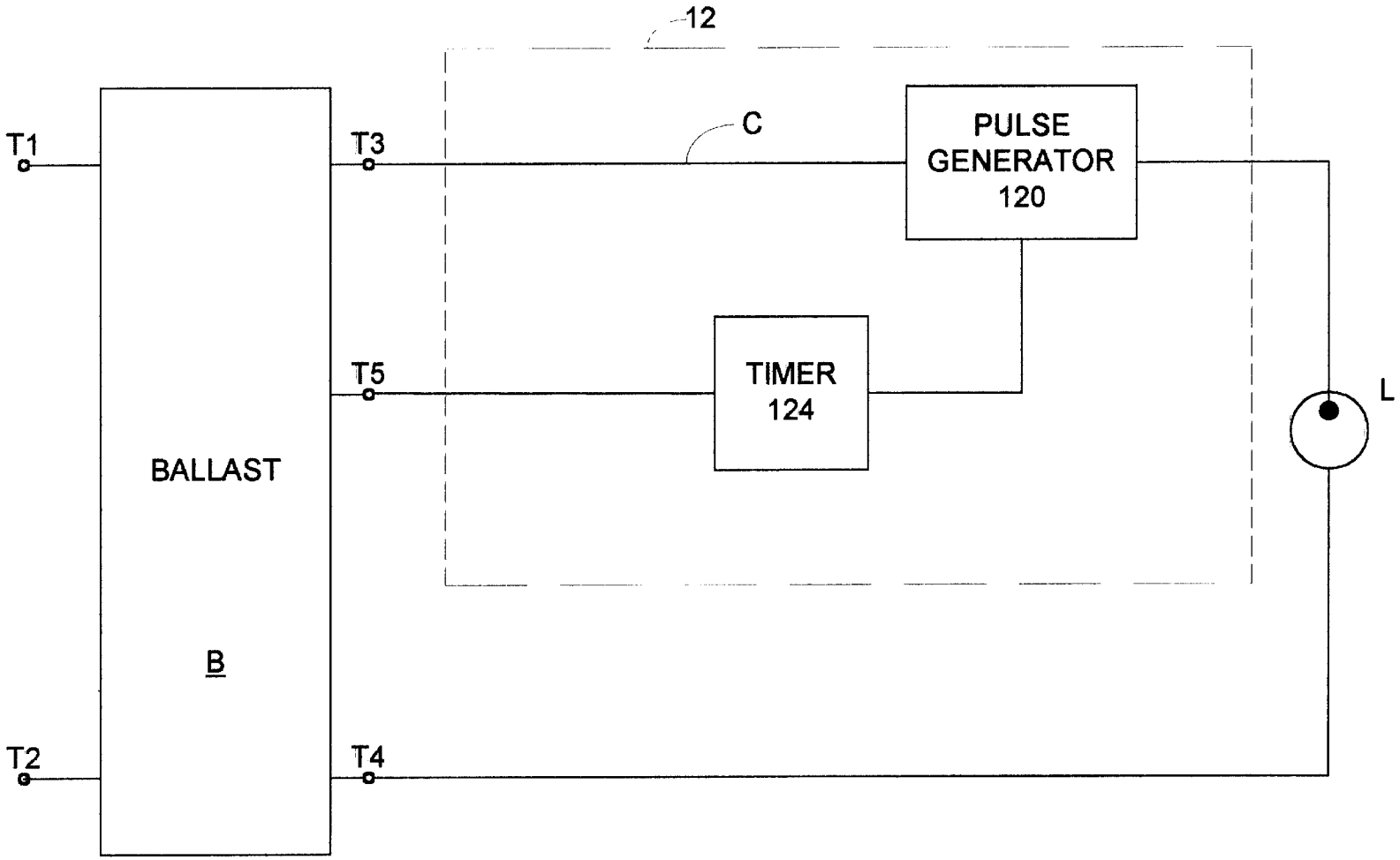
FIG. 1 PRIOR ART
FIG. 1 is a block diagram of a known circuit arrangement for powering a gaseous discharge lamp.
Figure 2:
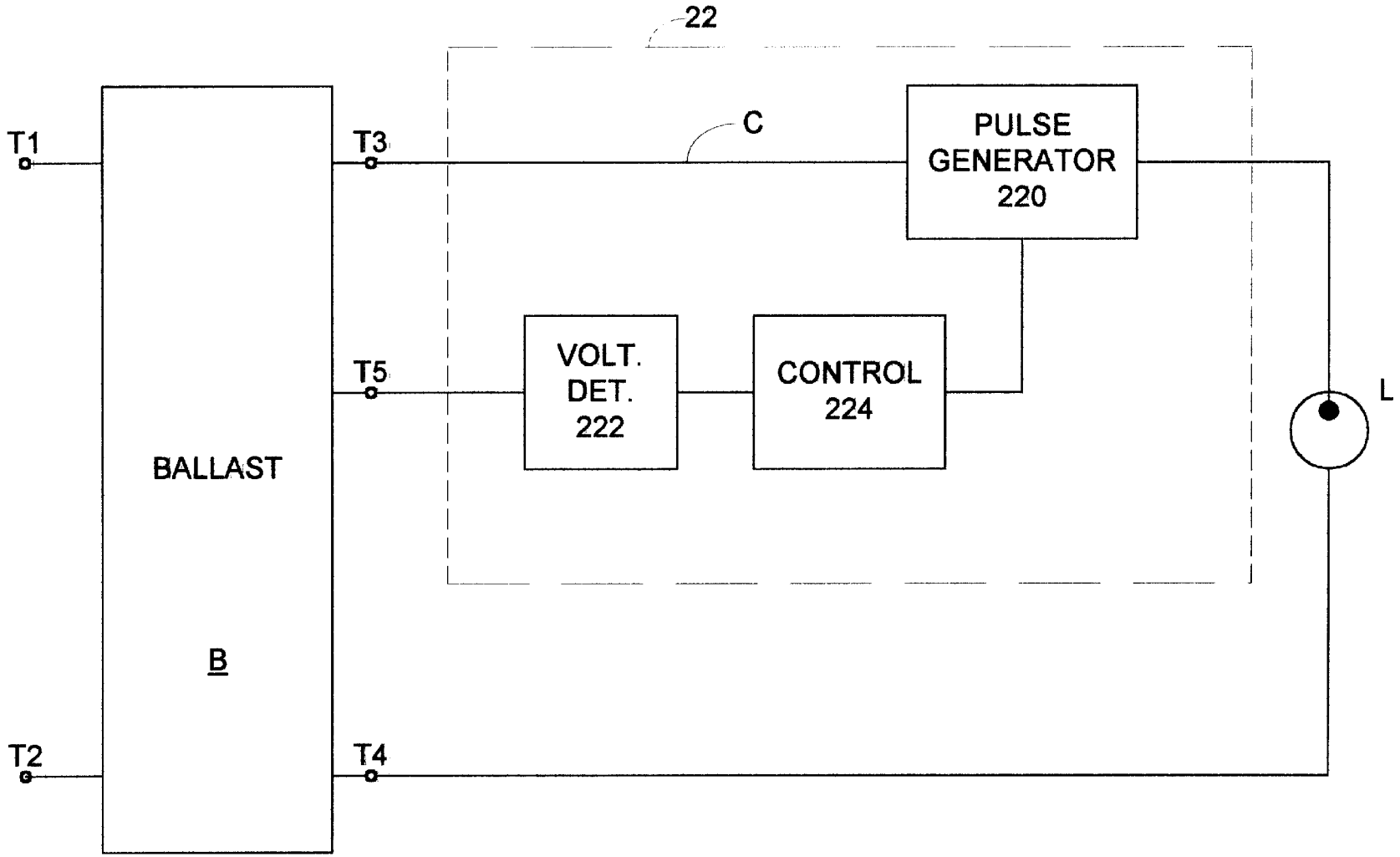
FIG. 2 is a block diagram of a first embodiment of a circuit arrangement in accordance with the invention.

FIG. 2 illustrates a preferred embodiment of a circuit arrangement for igniting and powering a gaseous discharge lamp in accordance with the invention. Similarly to FIG. 1, the circuit arrangement includes a ballast B for powering a gaseous discharge lamp L, which is electrically connected to terminals T3 and T4, when a source of AC voltage is connected to terminals T1 and T2. Also as in FIG. 1, the circuit arrangement has an ignitor 22 including a pulse generator 220 for applying high-voltage pulses to the lamp L to effect ignition. Any ballast B and pulse generator 220, which are adapted for igniting and powering the specific gaseous discharge lamp L, may be employed In addition to the pulse generator 220, the ignitor 22 includes a voltage detector 222 and control circuitry 224 for controlling ignition and operation of the lamp L by utilizing a plurality of known operating characteristics of the lamp. These include voltage characteristics and time-period characteristics.

Figure 3A:
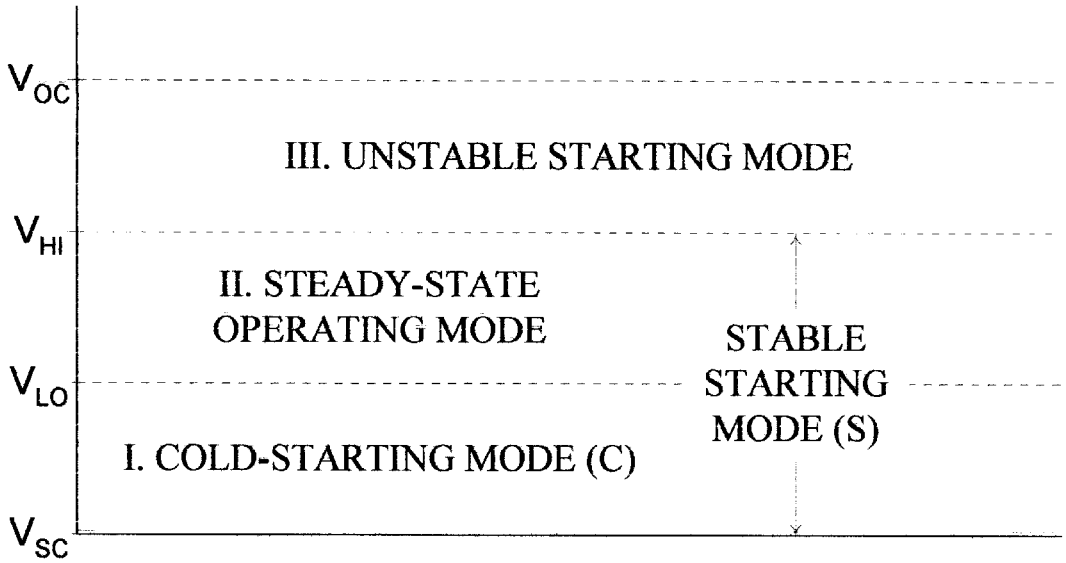
FIGS. 3A–3D are characteristic diagrams illustrating different operating modes of gaseous discharge lamps.

FIG. 3A illustrates some known voltage characteristics of a gaseous discharge lamp which are useful in determining its instantaneous mode of operation. These modes of operation include:

- a cold-starting mode I, where the voltage across the lamp L is in a range between $V_{LO}$ and $V_{SC}$;
- a steady-state operating mode II, where the voltage across the lamp L is in a range between $V_{HI}$ and $V_{LO}$;
- an unstable starting mode III, where the voltage across the lamp L is in the range between $V_{HI}$ and $V_{OC}$.

The voltages $V_{SC}$ and $V_{OC}$ are the short-circuit and open-circuit voltages that would be measured across the lamp socket if the lamp L is replaced with a short circuit or an open circuit, respectively. The voltage $V_{LO}$ defines a boundary between the cold-starting mode I and the steady-state operating mode II. This is a lamp voltage, above which a just-started cold lamp is known to have reached a stable burning state, so that ignition power may be discontinued. The voltage $V_{HI}$ defines a boundary between the steady-state operating mode II and the unstable starting mode III.

This is a lamp voltage above which the ballast powering a burning lamp is potentially incapable of sustaining the lamp in the burning state. The boundary voltages $V_{HI}$ and $V_{LO}$ are chosen from known characteristic voltage data for a gaseous discharge lamp of the specific type or family of types to be ignited by the pulse generator 220.

Figure 4:
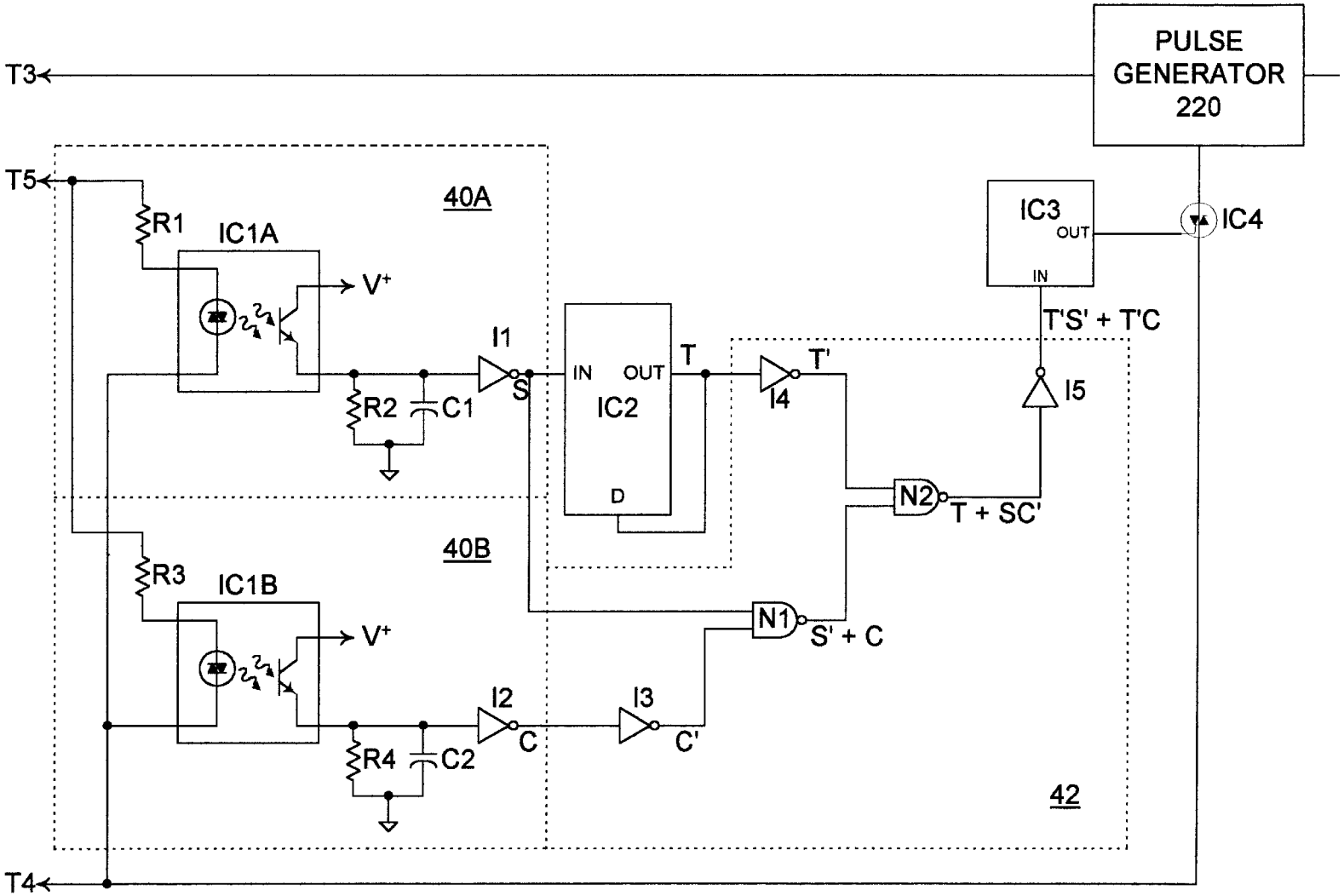
FIG. 4 is a schematic diagram illustrating an embodiment of an ignitor in accordance with the invention.

FIG. 4 illustrates an embodiment of the ignitor 22, shown in FIG. 2. In this embodiment, the ignitor includes threshold detectors 40A and 40B, a timer IC2, logic circuitry 42, a switching control circuit IC3, and a semiconductor switch IC4. Note that all of these elements are connected to a power supply (not shown) for providing the DC voltages needed for their operation.

The threshold detectors 40A and 40B are each electrically connected to the terminal T5 for sensing the lamp voltage. This may be done, for example, by connecting terminal T5 to terminal T3, internally of the ballast B. As another alternative, terminal T5 may be connected to a tap in the ballast B where a voltage proportional to the lamp voltage is produced. The semiconductor switch IC4 is electrically connected as an AC switch in series with terminal T3, the pulse generator 220, and the terminal T4. Whenever the semiconductor switch is in a conducting state, it permits current to flow through the pulse generator, thereby enabling it to produce and apply high-voltage igniting pulses to the lamp L.

The threshold detector 40A includes an opto-coupler IC1A having a bidirectional photodiode which is optically coupled to a phototransistor. The photodiode is electrically connected through a resistor R1 to terminal T5 and is electrically connected directly to terminal T4 to complete a current path to the ballast B. The phototransistor has an emitter electrode that is electrically connected to an input of an inverter I1 and through the parallel combination of a resistor R2 and a capacitor C1 to DC ground. A collector electrode of the phototransistor is electrically connected to a DC source of positive voltage $V^+$. The output of the inverter I1 serves as the output of this threshold detector.

The values of the resistors R1 and R2 are chosen to effect production (at the input of inverter I1) of the threshold voltage at which the inverter I1 output changes state, whenever the voltage across the lamp L is equal to the voltage $V_{HI}$. As shown in FIG. 3A, this is the voltage defining the boundary between the stable starting mode and the unstable starting mode. At any lamp voltage below $V_{HI}$, the output of inverter I1 is in a logical state S, indicating that the lamp is in the stable starting mode. At any lamp voltage above $V_{HI}$, the output of inverter I1 is in the opposite logical state S', indicating that the lamp is in the unstable starting mode. The value of the capacitor C1 is chosen (relative to the value of the resistor R2) to dampen AC ripple.

Similarly, the threshold detector 40B includes an opto-coupler IC1B having a bidirectional photodiode which is optically coupled to a phototransistor. The photodiode is electrically connected through a resistor R3 to terminal T5 and is electrically connected directly to terminal T4. The phototransistor has an emitter electrode that is electrically connected to an input of an inverter I2 and through the parallel combination of a resistor R4 and a capacitor C2 to ground. A collector electrode of the phototransistor is electrically connected to the DC source of the positive voltage $V^+$. The output of the inverter I2 serves as the output of this threshold detector.

The values of the resistors R3 and R4 are chosen to effect production (at the input of inverter I2) of the threshold voltage at which the inverter I2 output changes state, whenever the voltage across the lamp L is equal to the voltage $V_{LO}$. As shown in FIG. 3A, this is the voltage defining the boundary between the steady-state operating mode and the cold-starting mode. At any lamp voltage below $V_{LO}$, the output of inverter I2 is in a logical state C, indicating that the lamp is in the cold-starting mode. At any lamp voltage above $V_{LO}$, the output of inverter I2 is in the opposite logical state C', indicating that the lamp is not in the cold-starting mode. The value of the capacitor C2 is chosen (relative to the value of the resistor R4 ) to dampen AC ripple.

The timer IC2 is a programmable counter with an internal clock. The timer is programmed to set both the clock rate and a count corresponding to a chosen time. The timer has an input IN that is electrically connected to the output of the inverter I1, an output OUT at which it will produce either a signal T indicating that the full count has been reached (i.e., the timer has timed out) or a signal T' indicating that it has not timed out. The timer also has a disable input D that is electrically connected to the output of the timer. Further, the timer has DC power terminals (not shown), which are electrically connected to a DC power source that is energized whenever power is applied to the lamp L via the terminals T3 and T4 of the ballast B. This enables automatic resetting of the timer whenever power is initially applied to the lamp by the ballast and whenever power to the lamp is reinitiated after an interruption.

The timer will reset to a zero count:

whenever power is initially applied to the terminals T3 and T4;

whenever power is reapplied to terminals T3 and T4 after an interruption;

whenever the signal at the output of the inverter I1 changes from the state S' to the state S, provided that the timer has not timed out (and thus applied the signal T to the disable input D).

The timer will start counting whenever the signal applied to the input IN (by the inverter I1) changes from the state S to the state S', provided that the timer has not timed out (and thus applied the signal T to the disable input D).

The logic circuit 42 includes inverters I3, I4, I5 and nand gates N1, N2. The logic circuit is configured to produce at the output of the inverter I5 (which serves as the output of the logic circuit) a signal having a logical ONE state only when either of the following conditions exist:

The states T' and S' exist simultaneously at the outputs of the timer IC2 and the threshold detector 40A, respectfully (thereby indicating that the timer has not yet timed out and that the lamp L is in the unstable-starting mode).

The states T' and C exist simultaneously at the outputs of the timer IC2 and the threshold detector 40B, respectfully (thereby indicating that the timer has not yet timed out and that the lamp L is in the cold-starting mode).

Only when either of these conditions exist, will the semiconductor switch IC4 be maintained in an ON (conducting) state, thereby permitting the pulse generator 220 to apply igniting pulses to the lamp L.

The switching control circuit IC3 has an output electrically connected to a gate input of the semiconductor switch IC4 and has an input electrically connected to the output of the logic circuit 42. The circuit IC3 produces an output for driving the semiconductor switch IC4 into the ON state when a logical ONE is applied to its input.

Following is a list of exemplary parts that may be used for the circuit components shown in FIG. 4 to produce an ignitor which will detect the specific boundary voltages $V_{HI}$=73 Volts AC RMS and $V_{LO}$=25 Volts AC RMS, and where the voltage $V^+$=10 Volts DC:

| COMPONENT | PART |
|---|---|
| R1, R3 | 39 kΩ, 1 Watt |
| R2 | 3 kΩ, 1/8 /Watt |
| R4 | 13 kΩ, 1/8 Watt |
| C1, C2 | 10 μF, 50 VDC |
| I1–I5 | MOTOROLA MC14093 nand gates |
| N1, N2 | MOTOROLA MC14093 nand gates |
| IC1 | SHARP PC824 dual opto coupler |
| IC2 | MOTOROLA MC14536 timer |
| IC3 | SHARP S21MD7T single opto coupler |
| IC4 | TECCOR Q4004L3 triac |

Note that, for simplification, some circuit elements, which are specified in data sheets provided by the manufacturers of the ICs (e.g., current-limiting resistors, RC timing elements for the timer to etc.) are neither shown in FIG. 4 nor listed above.

The timer is programmed, in accordance with the manufacturer's specifications, to time out after running for 5 seconds. The ignitor with these specific components was designed to operate high-pressure sodium lamps having rated operating voltages of 52–55 Volts AC RMS. These include lamps in the family of ANSI-designation types S54, S55, S62, S68 and S76.

The boundary voltages and time-out period for any specific gaseous discharge lamp are determined from the specifications for the lamp. For example, in FIG. 5 is a table listing examples of ANSI specifications for a group of metal-halide lamps and of boundary voltages which have been selected for them. Each of these lamps is designed to operate within a certain voltage range and to be powered with a minimum open-circuit voltage (OCV). For example, an M130 metal-halide lamp, having a rated power of 39 watts, is designed to operate (in its fully ignited state) within a voltage range of 80–100 Volts AC RMS and to require a minimum open-circuit supply voltage of $V_{OC}$=198 Volts RMS.

The upper threshold voltage $V_{HI}$ is determined by choosing a value between the highest expected lamp-operating voltage and the lowest expected OCV of the power source, e.g. that of the ballast B in FIG. 2. The highest expected lamp-operating voltage is determined by taking into consideration not only the ANSI-specified value for the high end of the lamp operating voltage range, but also variations of the power-source OCV, plus any expected increase in the lamp operating voltage as a result of aging. Using the example of the M130 metal-halide lamp and the example of a reactor-type ballast having a voltage regulation capability of ±10%, we can expect the upper operating voltage of the lamp to increase from a the upper ANSI specification of 100 V RMS to 110 V RMS. Further, if the operating voltage of the lamp is expected to drift upward with age (e.g. by 10% at its end of useful life), then the maximum actual operating voltage expected for the lamp will be 110%×110 V=121 V RMS. Any lamp voltage greater than 121 V RMS can be interpreted as an open-circuit condition, i.e. a dark lamp. This is the highest expected lamp-operating voltage. The lowest expected OCV of the power source in this example is 90% of 198 V RMS=187.2 V RMS. Thus, the upper threshold voltage $V_{HI}$ may be set anywhere between 121 and 187.2 V RMS for the M130 metal-halide lamp with the exemplary power source and lamp operating-voltage drift.

The lower threshold voltage $V_{LO}$ is determined by choosing a value that is lower than the lower ANSI specification of 80 V RMS for the exemplary M130 metal-halide lamp. Allowing for the possible −10% variation of the ballast output voltage, i.e. 90% of 80 V RMS=72 V RMS, the lower threshold voltage should be set at some value below 72 V RMS, but above the lowest voltage that a lamp will begin to burn during cold starting. For the M130 metal-halide lamp, powered by the exemplary ballast, this voltage has been found to be approximately 30 V RMS. Thus the lower threshold voltage $V_{LO}$ may be set anywhere between 30 and 72 V RMS.

Note that several lamps of the same type, but having different power ratings, may operate at similar voltages. In such case, they may be grouped into "voltage families" nand be ignited using the same upper and lower threshold voltages for $V_{HI}$ and $V_{LO}$, respectively.

The time out period is determined principally by taking into consideration the lamp type, the starting capabilities of the pulse generator used (e.g. conventional or rapid restrike), and the estimated time needed to restrike a functional hot lamp. If a rapid-restrike pulse generator is not used, the rate of cooling of the lamp must also be taken into consideration. For example, a metal-halide lamp may take 3–4 minutes, or 10–15 minutes to cool down to a temperature at which it can be restarted by a conventional pulse generator, depending on the fixture in which it is mounted. For the same lamp, started by a rapid-restrike pulse generator, only seconds (e.g. 20 seconds) may be needed for restarting.

In operation, the ignitor of FIG. 4 controls the application of igniting pulses to the lamp L, from the instant that power is applied (or reapplied after an interruption) to the ignitor itself and to the lamp. Whether (and for how long) igniting pulses are applied to the lamp, will depend on what lamp voltage is detected at terminal T5. Operation of the ignitor under different conditions will be explained with reference to FIGS. 3B–3D and 4 together. Note that FIGS. 3B–3D are not drawn to scale but are provided principally to demonstrate the sequences of events in starting a gaseous discharge lamp under different conditions.

Figure 3B:
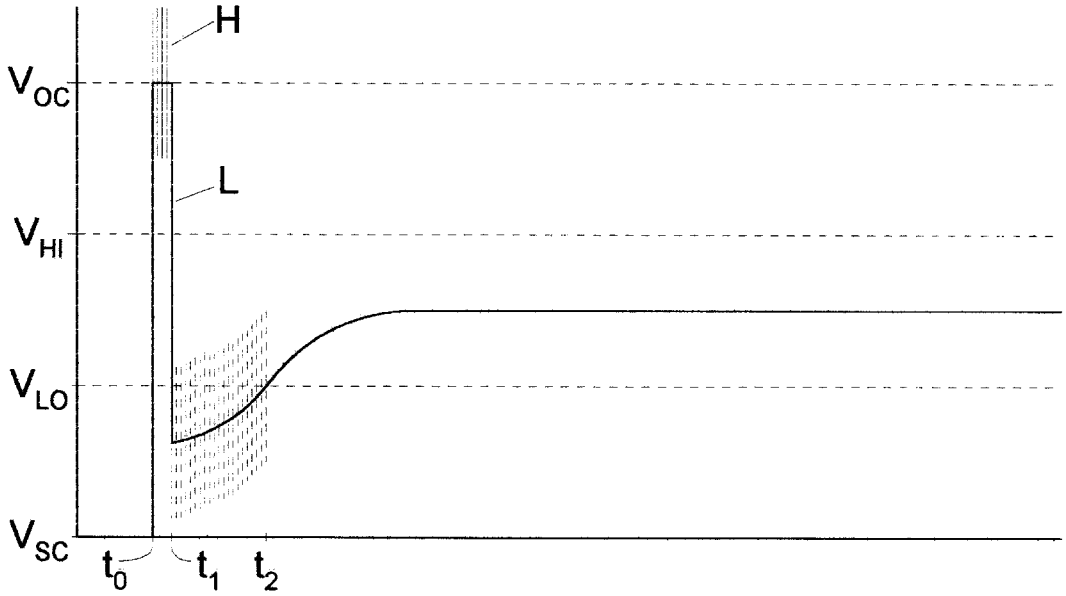
Figure 3C:
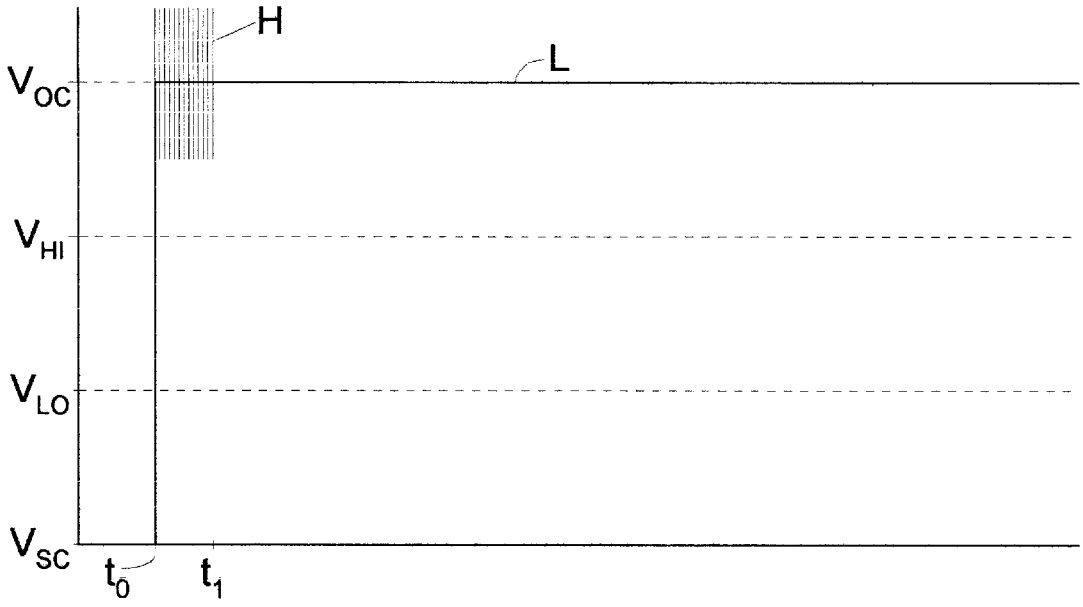
Figure 3D:
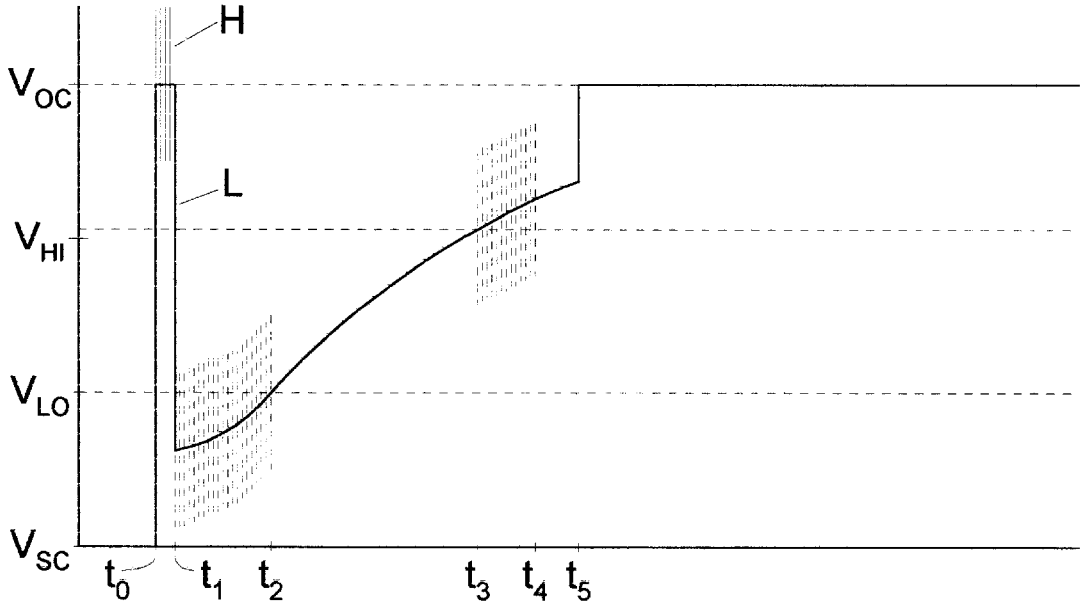

FIG. 3B is an exemplary lamp-voltage versus time curve illustrating operation of the ignitor during cold starting of a typical gaseous-discharge lamp. Note that the lamp voltage has two different components, i.e., a lower-frequency ballast-power component L and a higher-frequency igniting-pulse component H. The starting sequence illustrated in FIG. 3B occurs as follows:

Upon the application of electrical power to the lamp by the ballast at a time $t_0$, the lamp presents an open circuit across the terminals T3 and T4. The lamp voltage, detected at terminal T5, rapidly climbs from $V_{SC}$ to $V_{OC}$ and causes the output of inverter I1 to change state from S to S'. This causes the timer IC2 to begin counting while producing the output T', indicating that it has not yet timed out. While the timer produces the output T' and the inverter I1 simultaneously produces the output S', the logic circuit 42 produces a logical ONE output, thereby causing switching control circuit IC3 to drive switch IC4 into conduction. This enables pulse generator 220 to apply igniting pulses H to the lamp L substantially simultaneously with the application of ballast power at the time $t_0$.

During an interval between the time $t_0$ and a time $t_1$, the pulse generator 220 applies high-voltage pulses to the lamp.

At time $t_1$, the lamp begins to ignite and the lamp voltage suddenly decreases to a voltage below $V_{LO}$. This causes the output of inverter I1 to change state from S' to S (as the lamp voltage decreases below $V_{HI}$), but causes the output of inverter I2 to change state from C' to C (as the lamp voltage decreases below $V_{LO}$), and causes the timer IC2 to be reset and to stop counting (as the output of inverter I1 changes state from S' to S). Resetting the timer causes its output to stay in the already-existing state T'. Thus, inverter I2 is producing the output signal C while the timer is simultaneously producing the output signal T'. As long as this condition continues to exist, the logic circuit 42 produces a logical ONE output. This causes switching control circuit IC3 to attempt to keep triac switch IC4 in its ON conducting state, thereby permitting the pulse generator 220 to continue to apply the ignition pulses to the lamp (as indicated by the dashed-line pulses). In actuality, the pulse generator will stop producing the high voltage pulses at time $t_1$ when the lamp voltage suddenly decreases and falls below a minimum pulse-producing voltage. Typically, this minimum voltage is a breakover voltage of a voltage-sensitive switch, e.g. a sidac, in the pulse generator. However, the continued logical ONE output from the logic circuit 42 enables the pulse generator to immediately reapply pulses through switch IC4 if the lamp begins to extinguish.

During an interval between the time $t_1$ and a time $t_2$ , the lamp voltage gradually increases as the lamp enters a stable burning state.

At time $t_2$ the lamp voltage increases through the boundary voltage $V_{LO}$, at which it is known to be fully ignited and capable of stable operation, i.e. in the steady-state operating mode. At this time the output of inverter I1 remains in the state S, while the output of inverter I2 changes state from C to C', and the output of the logic circuit changes to a logical ZERO. This causes switching control circuit IC3 to turn switch IC4 OFF, thereby preventing the production of ignition pulses by the pulse generator 220.

Following time $t_2$ , the lamp voltage will continue an asymptotic climb until reaching a final steady-state operating voltage somewhere in the range between $V_{LO}$ and $V_{HI}$.

FIG. 3C illustrates operation of the ignitor if the lamp is broken, missing, burned out, or otherwise non-functional. The starting sequence is as follows:

Upon the application of electrical power by the ballast at a time $t_O$, the non-functional lamp presents an open circuit across the terminals T3 and T4. The lamp voltage, detected at terminal T5, rapidly climbs from $V_{SC}$ to $V_{OC}$ and causes the output of inverter I1 to change state from S to S'. This causes the timer IC2 to begin counting and to produce the output T'. While the timer output is in the state T' simultaneously with the inverter I1 output being in the state S', the logic circuit 42 produces a logical ONE output, thereby causing switching control circuit IC3 to drive switch IC4 into conduction. This enables pulse generator 220 to apply igniting pulses H to the non-functional lamp L substantially simultaneously with the application of ballast power at the time $t_0$.

Because the lamp is non-functional, it does not go into ignition and the lamp voltage remains at $V_{OC}$. The outputs of the inverters I1 and I2 do not change state, but remain at S' and C', respectively.

At time $t_1$, the timer reaches the count corresponding to the time interval at which it times out and produces the output T. This disables further counting by the timer (until it is reset) and causes the output of the logic circuit 42 to change state to a logical ZERO. This causes switching control circuit IC3 to turn switch IC4 OFF, thereby stopping production of ignition pulses by the pulse generator 220.

FIG. 3D illustrates operation of the ignitor for a "cycler", i.e., a lamp having a higher steady-state operating voltage than can be provided by the ballast. This commonly occurs with some types of gaseous discharge lamps (e.g. HPS) as they age. The starting sequence (i.e. from a time $t_0$ to a time $t_2$) is initially the same as that shown in FIG. 3B. That is:

Upon the application of electrical power to the lamp by the ballast at a time $t_0$, the lamp presents an open circuit across the terminals T3 and T4. The lamp voltage, detected at terminal T5, rapidly climbs from $V_{SC}$ to $V_{OC}$ and causes the output of inverter I1 to change state from S to S'. This causes the timer IC2 to begin counting while producing the output T', indicating that it has not yet timed out. While the timer produces the output T' and the inverter I1 simultaneously produces the output S', the logic circuit 42 produces a logical ONE output, thereby causing switching control circuit IC3 to drive switch IC4 into conduction. This enables pulse generator 220 to apply igniting pulses H to the lamp L substantially simultaneously with the application of ballast power at the time to.

During an interval between the time $t_0$ and a time $t_1$, the pulse generator 220 applies high-voltage pulses to the lamp.

At time $t_1$, the lamp begins to ignite and the lamp voltage suddenly decreases to a voltage below $V_{LO}$. This causes the output of inverter I1 to change state from S' to S (as the lamp voltage decreases below $V_{HI}$), but causes the output of inverter I2 to change state from C' to C (as the lamp voltage decreases below $V_{LO}$), and causes the timer IC2 to be reset (as the output of inverter I1 changes state from S' to S). Resetting the timer causes its output to stay in the already-existing state T'. Thus, inverter I2 is producing the output signal C while the timer is simultaneously producing the output signal T'. As long as this condition continues to exist, the logic circuit 42 produces a logical ONE output. This causes switching control circuit IC3 to attempt to keep triac switch IC4 in its ON conducting state, thereby permitting the pulse generator 220 to continue to apply the ignition pulses to the lamp (as indicated by the dashed-line pulses). In actuality, the pulse generator will stop producing the high voltage pulses at time $t_1$ when the lamp voltage suddenly decreases and falls below the minimum pulse-producing voltage (e.g. sidac break-over voltage). However, the continued logical ONE output from the logic circuit 42 enables the pulse generator to continually reapply pulses through switch IC4 if the lamp begins to extinguish.

During an interval between the time $t_1$ and a time $t_2$, the lamp voltage gradually increases as the lamp enters a stable burning state.

At time $t_2$ the lamp voltage increases through the boundary voltage $V_{LO}$, at which it is known to be fully ignited and capable of stable operation, i.e. in the steady-state operating mode. At this time the output of inverter I1 remains in the state S, while the output of inverter I2 changes state from C to C', and the output of the logic circuit changes to a logical ZERO. This causes switching control circuit IC3 to turn switch IC4 OFF, thereby preventing the production of ignition pulses by the pulse generator 220.

Following time $t_2$, the lamp voltage will continue an asymptotic climb until reaching a final steady-state operating voltage somewhere in the range between $V_{HI}$ and $V_{OC}$.

At time $t_3$, the lamp voltage increases through the boundary voltage $V_{HI}$, causing the output of inverter I1 to change state from S to S'. This again causes the timer IC2 to begin counting and to produce the output T'. While the timer produces the output T' and the inverter I1 simultaneously produces the output S', the logic circuit 42 produces a logical ONE output, thereby causing switching control circuit IC3 to drive switch IC4 into conduction. Although this again permits the pulse generator 220 to apply igniting pulses H to the lamp, this permissive state continues only for the interval permitted by the timer IC2. Depending on the particular pulse generator employed, it may or may not generate igniting pulses during this permissive interval. Preferably, however, the boundary voltage $V_{HI}$ (at which the switching threshold of detector 40A is set) is too low to trigger the pulse generator into producing igniting pulses (e.g. too low to break over a voltage-sensitive switch in the pulse generator).

At time $t_4$, the timer reaches the count corresponding to the time interval at which it times out and produces the output T. This disables further counting by the timer (until it is reset) and causes the output of the logic circuit 42 to change state to a logical ZERO, which in turn causes switching control circuit IC3 to turn switch IC4 OFF and prevent production of ignition pulses by pulse generator 220.

At time $t_5$ the steadily increasing lamp voltage of the "cycler" reaches a level at which the ballast cannot sustain operation of the lamp. The lamp now extinguishes and its voltage increases to the level $V_{OC}$.

The disabled timer prevents the ignitor from making further attempts to ignite the lamp until it the timer is reset by removing power. Thus, a "cycler" lamp will ignite only once each time power is turned on.

Figure 6:
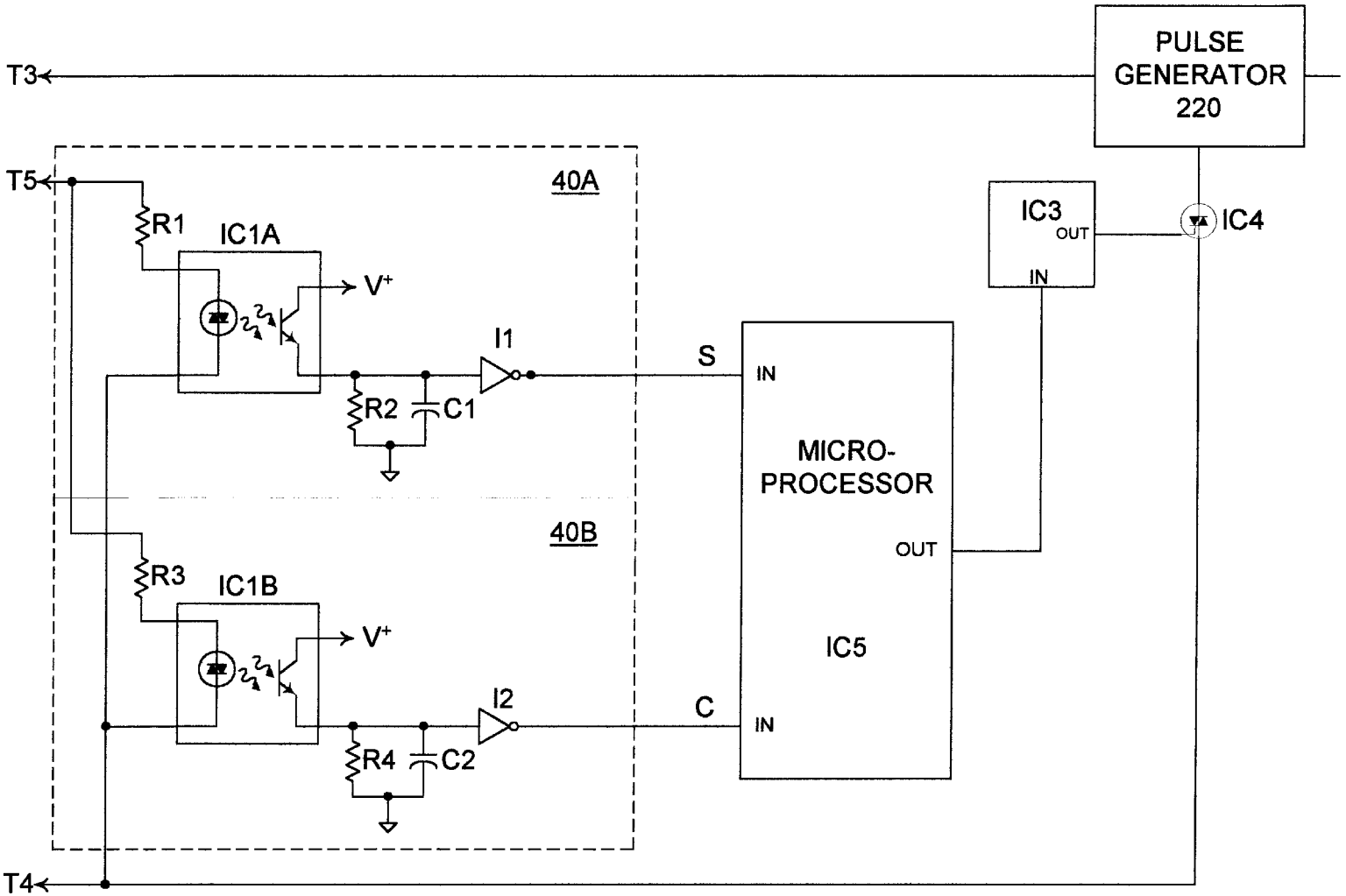
FIG. 6 is a block diagram of a second embodiment of a circuit arrangement in accordance with the invention.

Although the invention has been described with reference to the exemplary embodiments of FIGS. 2 and 4, many alternatives are possible. For example, different circuitry than that shown may be utilized. As another alternative, the invention may be carried out by using software rather than logic circuitry. FIG. 6 illustrates one way that this can be done, by replacing the logic circuit 42 and timer IC2 of FIG. 4 with a microprocessor IC5. The microprocessor is programmed to control the application of igniting pulses to the lamp in response to both elapsed time and the states of the signals at the outputs of the threshold detectors 40A and 40B.

Figure 7:
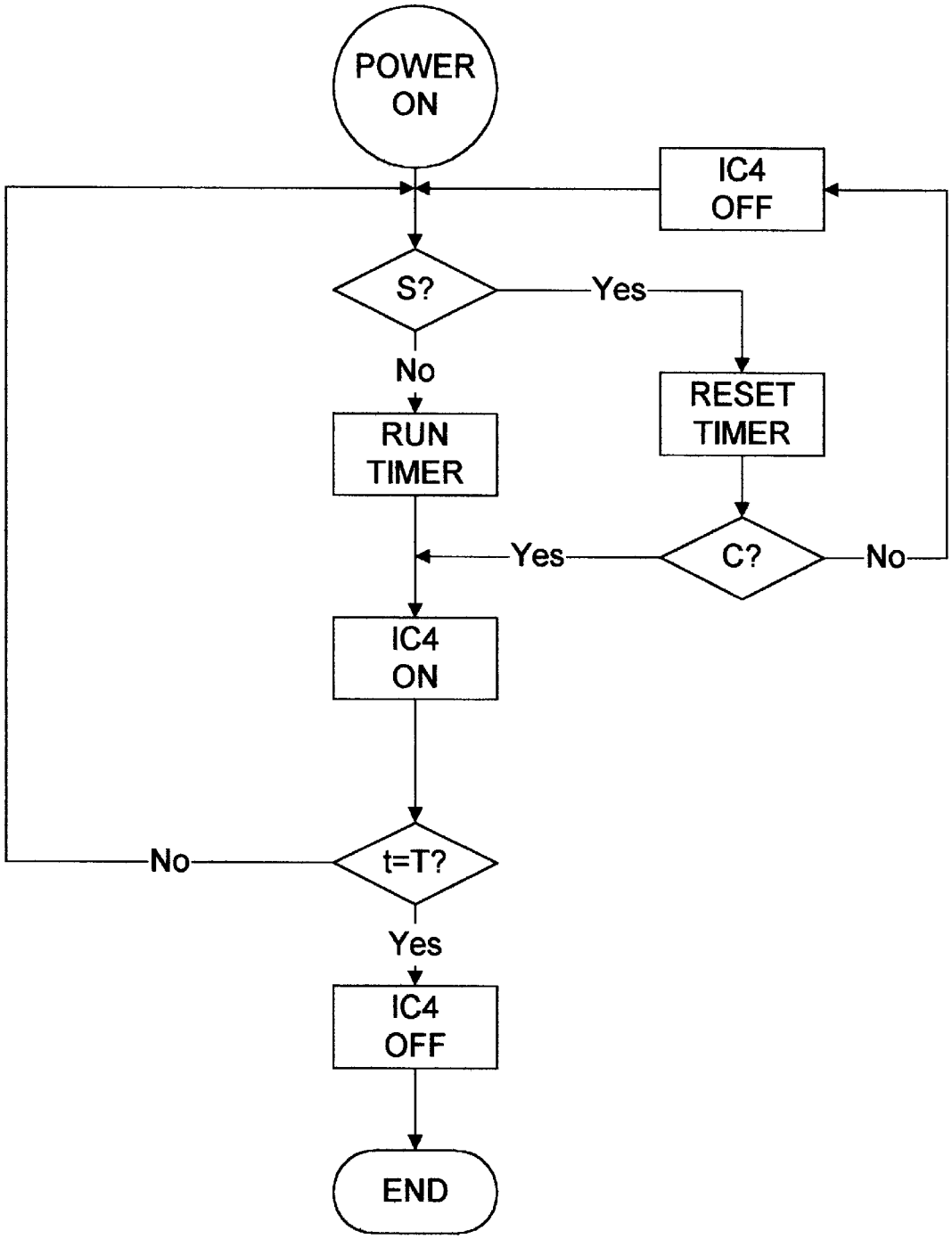
FIG. 7 is a flow diagram describing an exemplary method of operating the second embodiment.

FIG. 7 is a flow diagram illustrating an exemplary ignitor-control program executed by the microprocessor IC5. The individual steps represented by the flow diagram are explained below:

POWER ON: The ballast B and the ignitor 22 are powered up.

S?: This decision step determines whether or not the threshold detector 40A is producing the signal S, thereby indicating that the lamp is in the stable-starting mode (See FIG. 3A.)

RUN TIMER: The microprocessor runs a timer subprogram, which is counts until a pre-programmed timer count corresponding with a predetermined elapsed time period T (the timeout period for the specific lamp) is reached.

IC4 ON: The microprocessor produces an output signal (a logical ONE in the FIG. 6 embodiment) which causes the switching control circuit IC3 to drive the semiconductor switch IC4 into the ON (conducting) state, thereby permitting the pulse generator to apply igniting pulses to the lamp L.

IC4 OFF: The microprocessor produces an output signal (a logical ZERO in the FIG. 6 embodiment) which causes the switching control circuit IC3 to force the semiconductor switch IC4 into the OFF state, thereby preventing the pulse generator from applying igniting pulses to the lamp L.

C?: This decision step determines whether or not the threshold detector 40B is producing the signal C, thereby indicating that the lamp is in the cold-starting mode (See FIG. 3A.)

RESET TIMER: The microprocessor resets the timer sub-program to a count corresponding with zero elapsed time. t=T?: This decision step determines whether or not the timer count has reached the value corresponding with the elapsed time period T.

END: The microprocessor produces the logical ZERO output, keeping IC4 OFF, and stops running the program illustrated in FIG. 7.

What is claimed is:

1. Igniter circuitry for a gaseous discharge lamp, said circuitry comprising:

a. a pulse generator for applying igniting pulses to the lamp;

b. a voltage detector for sensing the lamp voltage;

c.control circuitry for controlling operation of the pulse generator in response to the sensing by the voltage detector of an upper threshold voltage and a lower threshold voltage, said control circuitry including:

i) timer circuitry for determining an elapsed time during which the sensed voltage remains higher than the upper threshold voltage;

ii) logic circuitry for permitting the pulse generator to apply the igniting pulses to the lamp if:

(1) the elapsed time has not exceeded a predetermined time period; and (2) the lamp voltage is either above the upper threshold voltage or below the lower threshold voltage.

2. Igniter circuitry as in claim 1 where the upper threshold voltage represents a lamp voltage above which the lamp is determined to be in an unstable starting mode.

3. Igniter circuitry as in claim 1 where the lower threshold voltage represents a lamp voltage below which the lamp is in a cold starting mode.

4. A method of controlling the application of igniting pulses to a gaseous discharge lamp, said method comprising sensing the lamp voltage and permitting the application of igniting pulses if:

a. igniting pulses have not been continuously applied to the lamp for an elapsed time exceeding a predetermined time period; and b. the lamp voltage is either above the upper threshold voltage or below the lower threshold voltage.

5. A method as in claim 4 where the upper threshold voltage represents a lamp voltage above which the lamp is determined to be in an unstable starting mode.

6. A method as in claim 4 where the lower threshold voltage represents a lamp voltage below which the lamp is in a cold starting mode.

7. Starting and operating circuitry for a gaseous discharge lamp, said circuitry comprising:

a. a ballast for providing power to the lamp;

b. a pulse generator for applying igniting pulses to the lamp;

c. a voltage detector for sensing the lamp voltage;

d. control circuitry for controlling operation of the pulse generator in response to the sensing by the voltage detector of an upper threshold voltage and a lower threshold voltage, said control circuitry including:

i) timer circuitry for determining an elapsed time during which the sensed voltage remains higher than the upper threshold voltage;

ii) logic circuitry for permitting the pulse generator to apply the igniting pulses to the lamp if:

(1) the elapsed time has not exceeded a predetermined time period; and (2) the lamp voltage is either above the upper threshold voltage or below the lower threshold voltage.

8. Starting and operating circuitry for a gaseous discharge lamp, said circuitry comprising:

a. a ballast for providing power to the lamp;

b. a pulse generator for applying igniting pulses to the lamp;

c. a voltage detector for sensing the lamp voltage;

d. a programmed microprocessor for controlling operation of the pulse generator in response to the sensing by the voltage detector of an upper threshold voltage and a lower threshold voltage, said microprocessor:

i) determining an elapsed time during which the sensed voltage remains higher than the upper threshold voltage;

ii) permitting the pulse generator to apply the igniting pulses to the lamp if:

(1) the elapsed time has not exceeded a predetermined time period; and (2) the lamp voltage is either above the upper threshold voltage or below the lower threshold voltage.

9. A method in a computer system for controlling the application of igniting pulses to a gaseous discharge lamp in response to the sensing of a first lamp voltage and a second lamp voltage, said method comprising:

i) determining an elapsed time during which the sensed voltage remains higher than the first lamp voltage;

ii) permitting the application of the igniting pulses to the lamp if:

(1) the elapsed time has not exceeded a predetermined time period; and (2) the sensed voltage is either above the first lamp voltage or below the second lamp voltage.

* * * * *